US005156295A

United States Patent [19]

Gordon et al.

[11] Patent Number: 5,156,295

[45] Date of Patent: Oct. 20, 1992

[54] BAG LINED CARTON WITH POUR SPOUT

[75] Inventors: Robert L. Gordon, Monroe; Linda A. Bernstein, Campbell Hall, both of N.Y.

[73] Assignee: International Paper Company, Purchase, N.Y.

[21] Appl. No.: 646,897

[22] Filed: Jan. 28, 1991

[51] Int. Cl.[5] ..... B65D 90/04; B67B 7/26

[52] U.S. Cl. ..... 220/416; 222/105; 222/183; 220/403; 220/712; 220/714

[58] Field of Search ..... 220/416, 105, 183, 403, 220/404, 86.1, 712, 714

[56] References Cited

U.S. PATENT DOCUMENTS

| | | |
|---|---|---|
| 2,177,918 | 10/1939 | Vogt et al. . |
| 2,365,159 | 12/1944 | Walton et al. . |
| 2,454,919 | 11/1948 | Hagan . |
| 2,950,037 | 8/1960 | Orsini . |
| 3,087,655 | 4/1963 | Scholle . |
| 3,143,249 | 8/1964 | Merrill et al. . |
| 3,361,309 | 1/1968 | Simkins . |
| 3,484,011 | 12/1969 | Greenhalgh et al. . |
| 4,076,147 | 2/1978 | Schmit . |
| 4,165,023 | 8/1979 | Schmit . |
| 4,214,675 | 7/1980 | Schmit . |
| 4,386,923 | 6/1983 | Okushita . |
| 4,488,661 | 12/1984 | Homma . |
| 4,560,090 | 12/1985 | Okushita . |

*Primary Examiner*—Joseph Man-Fu Moy
*Attorney, Agent, or Firm*—Michael J. Doyle; Walt Thomas Zielinski

[57] ABSTRACT

A carton construction for paperboard cartons such as those adapted to certain fruit juices or other potable liquids which require a barrier to protect the liquid. Present paperboard cartons for such liquids often include polymeric barrier layer materials and foils laminated to the paperboard or other stiff, foldable and resilient sheet material. Such barrier layer/foil materials increase the difficulty of recycling the paperboard after container use. Further, during the carton forming/sealing process, the polymeric surfaces of the container are heated to activate a heat sealable bond. This heating tends to crystallize the polymer and generate polymeric odors that are transmitted to the liquid product. These difficulties are overcome in the present invention by a bag and spout construction wherein the bag and spout are removed from the carton after use, thus permitting recycling of both the paperboard carton and the bag. In those situations requiring aseptic packaging of the liquid, the bag can be presterilized prior to its filling.

17 Claims, 3 Drawing Sheets

FIG. 1
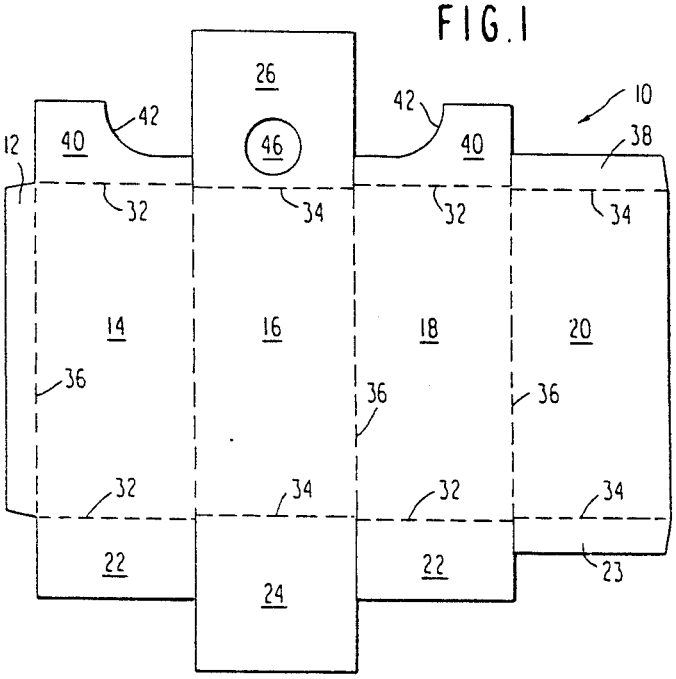
FIG. 2
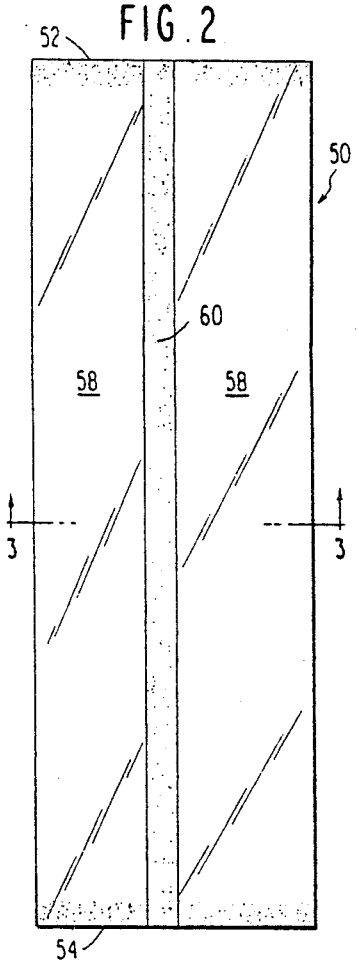
FIG. 6
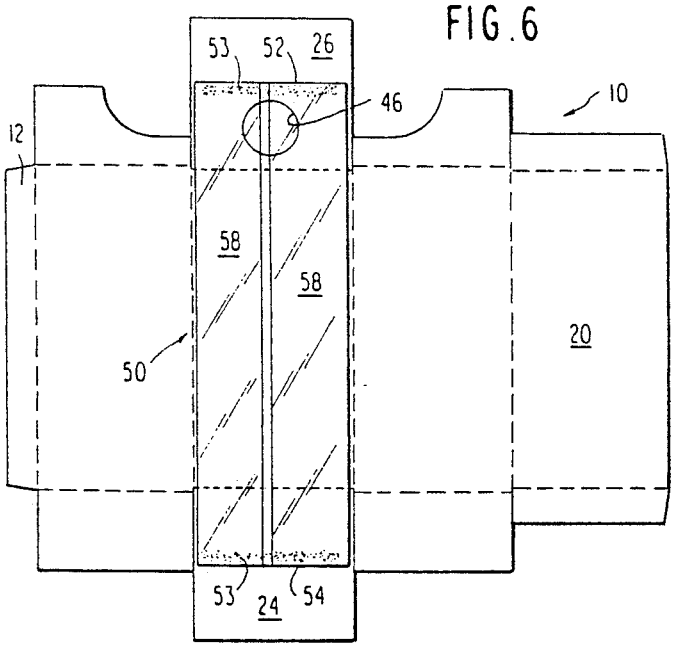
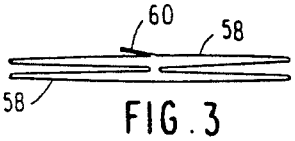
FIG. 3
FIG. 4
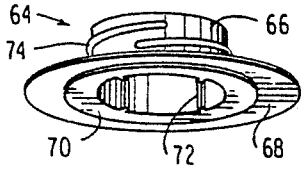
FIG. 5
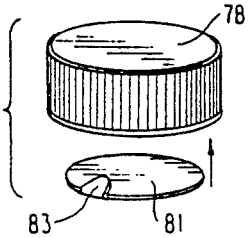

BAG LINED CARTON WITH POUR SPOUT

BACKGROUND OF THE INVENTION

This invention relates to containers of the type particularly adapted to contain milk, fruit juices, mineral water, or other potable liquids. A variety of constructions for such liquids is already known and includes, for example, the common gable top type carton for packaging milk and fruit juices. Such containers are fashioned from paperboard, with the paperboard usually coated on both surfaces with a thin layer of polyethylene. For certain types of liquids it is necessary to provide the carton with a barrier layer. This is often done by incorporating foil and/or other barrier layers with the paperboard.

Prior constructions for such liquids have not been entirely satisfactory, however, from the viewpoint of recycling discarded containers. For example, the inclusion of metal foil with the paperboard creates difficulties in separating the paperboard whenever it is desired to recycle. Further, such paperboard containers are often covered, at least on one side and usually on both sides, with a layer of polyethylene, with this layer used as an adhesive to heat seal the carton or container after it has been filled. It has been observed that whenever polymers of the type employed are heated to seal certain closure flaps of the carton together, some of the polymers crystallize and in turn come in contact with the liquid which is packaged, thus degrading the liquid to some extent with off-odors or off-taste.

SUMMARY OF THE INVENTION

According to the practice of this invention, the above drawbacks with prior liquid cartons or containers are overcome by the novel carton and bag liner of this invention. An integral paperboard blank is provided with a plurality of fold lines defining panels. A flexible side gusseted bag, in its collapsed or flattened condition, is glued at both of its ends to portions of the integral paperboard blank. One panel of the blank is provided with a dispensing opening, with a side portion of the flexible bag covering this opening. After the initial seaming operation of the blank, to form a flattened tube, a flanged dispensing nozzle fitment is placed over the dispensing opening on the flattened carton, the arrangement being such that one side portion of the bag is secured, as by an adhesive, to the radially innermost portion of the dispensing nozzle to thereby span and close the nozzle orifice. The radially outermost portion of the flange of the dispensing nozzle is adhesively secured to the exterior surface of that panel provided with the dispensing opening. Thereafter, the carton is erected and filled with a liquid. The filling includes the steps of placing a filling tube into the interior of the flanged dispensing nozzle, the end of the filling tube breaking or puncturing that portion of the bag which spans the flanged dispensing nozzle, and then filling the bag with a liquid such as fruit juice, mineral water, or the like.

The dispensing nozzle typically carries external screw threads for the reception of a cap, which is then placed on the dispensing nozzle to complete formation of the package, i.e., the carton and bag construction with a liquid in the bag.

After the container has been used and the bag emptied, the bag is removed from the carton by pulling the dispensing nozzle away to thus break the adhesive seal between the bag and the carton interior, and between the dispensing nozzle and the carton. The result is a paperboard container (without the common polyethylene coatings and barrier layers) capable of relatively easy recycling, and an empty plastic bag which is also easy to recycle. By this construction, separation of the parts for recycling is facilitated by the consumer, or processors working on discarded containers after the original user has thrown them away.

BRIEF DESCRIPTION OF THE DRAWINGS

FIG. 1 is a plan view of an integral paperboard blank, provided with fold lines and a dispensing aperture, for the formation of the container of this invention.

FIG. 2 is a plan view of the presealed, side gusseted plastic bag employed with this invention, and illustrates the bag in a collapsed or flattened condition.

FIG. 3 is a view taken along Section 3—3 of FIG. 2, and shows the configuration of the bag in its flattened condition. FIG. 3 shows the bag in a very slightly expanded condition for clarity of illustration.

FIG. 4 is a perspective view of the flanged dispensing nozzle of this invention.

FIG. 5 is a perspective view illustrating a screw closure cap and a sealing disc or membrane for sealing the dispensing nozzle.

FIG. 6 is a view similar to FIG. 1, and illustrates the location of the plastic bag of FIG. 2 relative to the blank of FIG. 1, the top and bottom ends of the bag having been releasably adhesively secured to a portion of the blank.

DETAILED DESCRIPTION OF THE INVENTION

Figure 7:
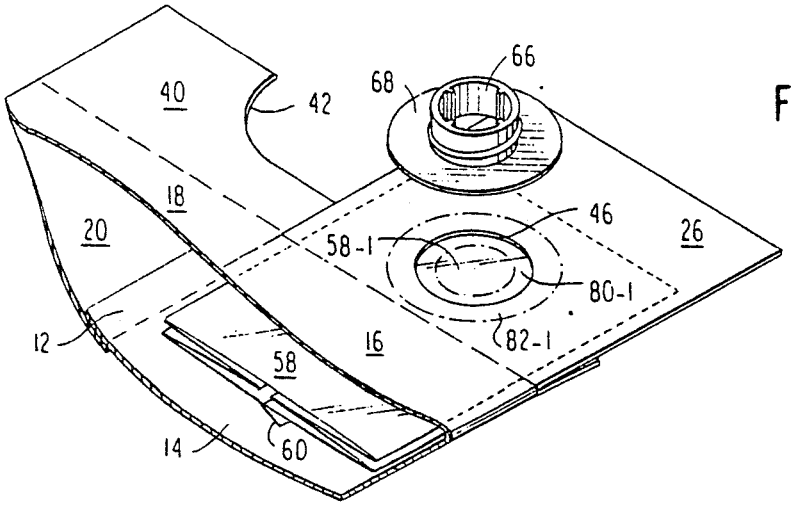
FIG. 7 is a partially broken, perspective view illustrating a further step in the formation of the container of this invention.

Referring to FIG. 1 of the drawings, the numeral 10 denotes generally an integral paperboard blank. The blank includes a plurality of sidewall forming panels, such as fifth flap or manufacturer's flap 12, and generally rectangular panels 14, 16, 18, 20. Bottom forming panels or flaps 22 are provided at the lower end of the sidewall forming panels 14 and 18, with sidewall forming panel 16 provided with a lower bottom forming flap 24, and the lower end of sidewall panel 20 carries bottom forming flap 23. The lower ends of the sidewall forming panels are provided with, respectively, horizontally extending fold lines 32, 34, 32, 34, with the same numerals indicating corresponding upper fold lines at the upper edges of the sidewall forming panels. It will be observed that adjacent horizontally extending fold lines 32, 34 are vertically offset slightly with respect to each other. A series of parallel, vertically extending fold lines 36 separate the manufacturer's flap and the sidewall forming panels from each other. Upper end closure forming panel 26, foldably secured to sidewall panel 16, is provided with a dispensing opening 46, typically die cut.

Referring now to FIGS. 2 and 3 of the drawings, a flexible bag 50 is illustrated having upper and lower closed ends 52 and 54, respectively, and having sidewalls therebetween denoted as 58. The bag includes a seam 60 running longitudinally between ends 52 and 54. The bag is fashioned from a foldable, puncturable sheet plastic, such as polyethylene, with the stippling shown at FIG. 2 indicating seal areas. During its attachment to the blank, soon to be described, bag 50 is in its flattened or collapsed condition, so that gusset edges along the sides of the bag, shown at FIG. 3, are very nearly touching. In practice, one would not see the spaces between the opposite gussets and upper and lower surfaces of the bag at FIG. 3, and hence the reader will understand that the spaces between the several runs or side surface portions of the bag are separated for purposes of illustration.

Turning now to FIG. 4, the numeral 64 denotes generally a flanged nozzle fitment, typically injection molded of a plastic such as polyethylene, and includes a short cylindrical portion 66 whose lower portion carries an integral flange having radial portions 68 and 70. Radially outermost flange portion 68 is thinner than radially innermost flange portion 70. The plurality of vertically extending ribs on the nozzle opening or lumen defined by cylinder 66 forms no part of this invention, and are used with the specific apparatus employed to form the nozzles, for the purpose of removing them from an injection molding apparatus which forms them. It is seen that flange portions 68, 70 form continuous annular portions or regions. Threads 74 are integrally molded on the exterior surface of cylindrical portion 68.

FIG. 5 is a perspective view of an internally threaded cap 78 and a circular heat sealable foil membrane 81 having an integral pull tab 83. Prior to the final formation of the package of this invention, membrane 81 is pushed up so that it meets the lower interior surface of the disc at the top of cap 78, for purposes which will be later explained.

Referring now to FIG. 6, bag 50 is shown as being placed on blank 10, which its upper and lower closed ends 52 and 54 adhesively secured to, respectively, flaps or panels 24 and 26, as indicated by 53. Any type of adhesive securement or attachment 53 may be employed, such as a continuous line or lines of adhesive, or spaced spots of adhesive. It will be observed that a portion of the bag overlies and completely covers or spans dispensing opening 46 in panel 26 and closes it.

Referring now to FIG. 7, blank 10 has been side seamed to form a flattened tube. Namely, the structure of FIG. 6 has been folded, and manufacturer's flap 12 has been glued to the right or free edge of sidewall forming panel 20. At FIG. 7, sidewall panel 16 and flap 26 have been turned over from the configuration shown at FIG. 6. Flanged nozzle fitment 64 is located over flap 26 such that its lumen or through opening is aligned with dispensing opening 46. Adhesive is placed on the annular surface area of portions 80-1 and 82-1, with the nozzle fitment placed on top of the adhesive resulting in the adhering of both a portion of bag 50 through opening 46 to the fitment at zone 80-1 and the fitment to a portion of the exterior surface portion 82-1 of flap 26. There is thus an annular zone of adhesive contact or securement between flange portion 68 and flap 26, and there is also an annular zone of adhesive contact or securement between flange portion 70 and bag 50. That portion of bag sidewall 58 which spans and closes the nozzle opening is denoted as 58-1.

Figure 8:
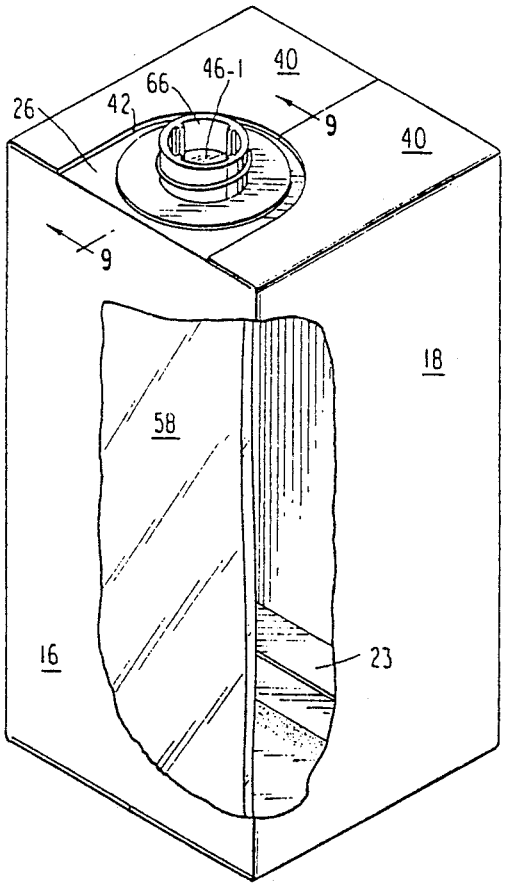
FIG. 8 is a partially broken, perspective view illustrating the erected container and the bag within of this invention.

At the completion of the process indicated and described with respect to FIG. 7, the elements are ready for final erection or setting up, and this is shown at FIG. 8. The bottom forming closures and the top forming closure panels have been secured together. As seen in FIG. 8, upper end closure flaps 40 are folded over panel 26. The offset between fold lines 34 and 32, shown at FIGS. 1 and 6, permits panels upper 40 to lie in a single plane, as do panels 26 and 38. Similarly, bottom closure panels 22 lie in one plane while bottom closure panels 23 and 24 lie in another plane.

Figure 9:
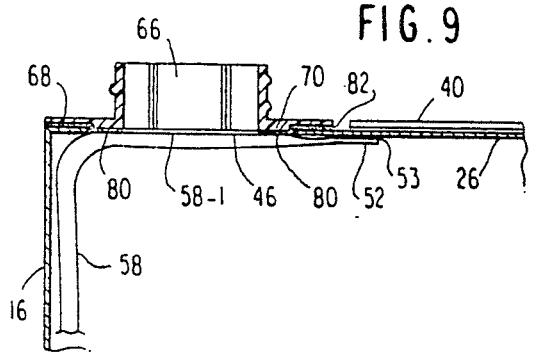
FIG. 9 is a view taken along Section 9—9 of FIG. 8.

FIG. 9 shows the relation between flange portion 68 and flap 26, with the lower surface of 68 annularly secured by adhesive 82 to zone 82-1 on the exterior surface of flap 26, see FIG. 7. Further, adhesive 80 defines an annular seal at region 80-1, again see FIG. 7, and attaches a portion 58-1 of the bag sidewall to flange portion 70 of the fitment nozzle.

Figure 11:
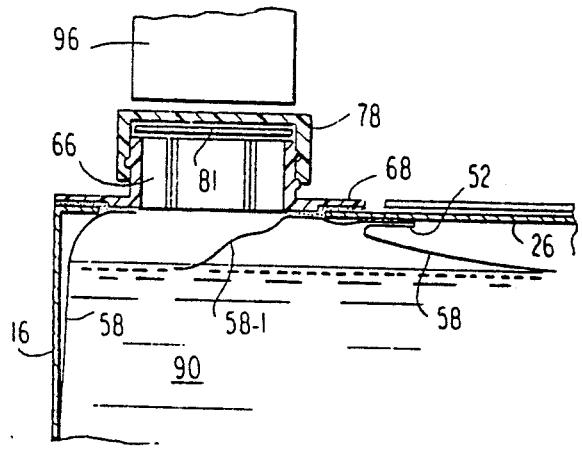
FIG. 11 is a longitudinal cross-sectional view, similar to FIG. 9, illustrating a method of sealing the container after filling.
Figure 12:
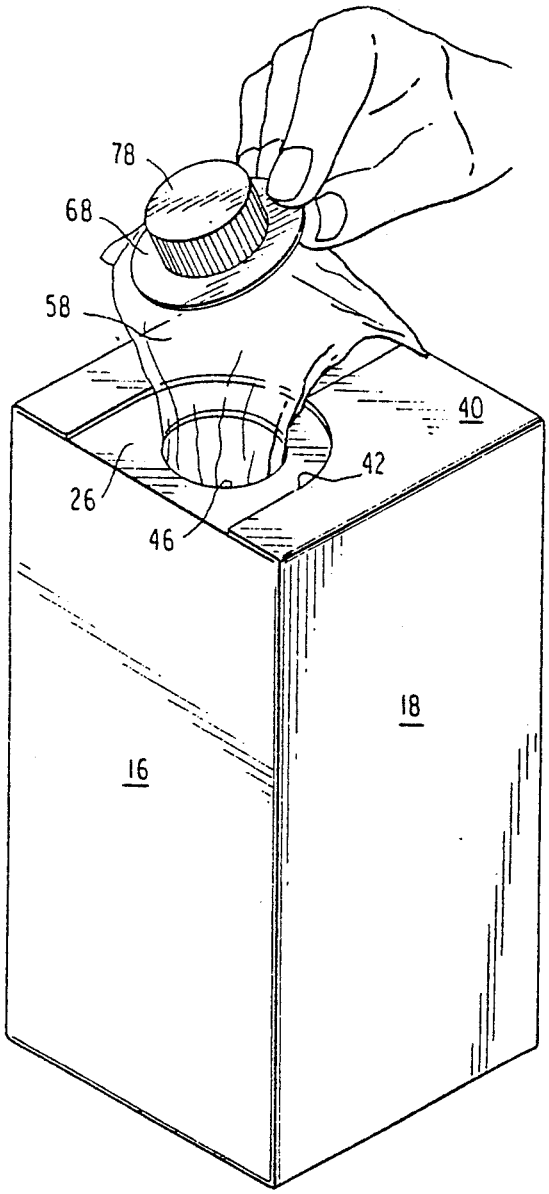
FIG. 12 is a perspective view illustrates the removal of the fitment nozzle and bag after the contents of the bag have been emptied from the container.

For a purpose which will later be described, the adhesive attachments 53 (only one of which is shown at FIGS. 9 and 11) between bag ends 52 and the carton, and the adhesive attachment 82 between outer flange portion 68 and panel 26, are both weaker than the adhesive attachment 80 between inner fitment portion 70 and bag 50. This differential in adhesive strength is readily obtained due to the fact that an adhesion between two polymers, for the same type of adhesive, is stronger than the adhesion between a polymer and the fibers in paperboard, the latter defining the carton walls.

Figure 10:
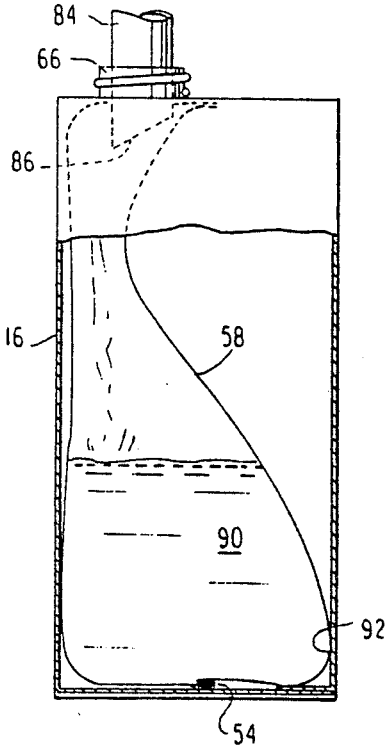
FIG. 10 is a partially broken view illustrating the container of FIG. 8 being filled with a liquid.

Referring now to FIG. 10 of the drawings, the fully erected container of FIG. 8 is placed beneath a cylindrical filling tube 84 such that the fitment opening or lumen is aligned with the tube. Typically, the lower portion of filling tube or spout 84 is canted, as indicated at 86. Canted tube end 86 punctures portion 58-1 of the bag which spans the lower nozzle opening and liquid is introduced into the bag. The liquid is indicated as 90, and it is seen that the bag is being filled. The relationship between the bag size and the interior of the carton is such that the bag, when filled with liquid, contacts the interior surfaces of the paperboard container, there being no air pockets. This surface to surface contact between the bag and the interior walls of the carton is indicated generally by 92.

At the completion of the filling process, screw cap 70 having separate sealing membrane 81 therein is screwed onto the fitment nozzle and is passed under an induction sealing device 96 and power applied to it. This results in a heat seal between the periphery of sealing membrane 81 and the upper rim of the nozzle fitment. This and other methods for attaching a sealing membrane to the top of a container dispensing nozzle are known in the container art and form no part of the invention. The membrane attachment step is shown at FIG. 11, it being understood that there is a separation of elements shown for purposes of clarity of description and illustration. At the completion of the sealing process indicated at FIG. 11, the filled container is now ready for shipment or sale to the ultimate user. As shown at FIG. 11, portion 58-1 of bag wall 58 has been ruptured by the filling tube, but the continuous annular seal between thicker flange portion 70 and the bag remains intact, thus insuring that the contents of the bag are protected from the environment by the lower portion of the bag, the seal afforded by adhesive 80 (see FIG. 9 also), and the now sealed membrane 81 on top of the dispensing nozzle.

After the liquid in the bag has been completely dispensed, the user, or someone at a recycling operation, pulls up on the screw cap, or alternatively on cylindrical portion 66 if the screw cap has been discarded, to thereby remove the bag from the paperboard container. As described earlier, this removal is made possible by the fact that the adhesion or securement between the nozzle fitment and the bag, afforded by adhesive 80, is stronger than both the adhesion or securement between fitment portion 68 and flap 26, and between adhesion or securement 53 between the ends of the bag and the interior surface of the carton.

The paperboard is typically from 0.016 to 0.022 inches in thickness and may be formed of solid bleached sulfate paperboard or recycled newsboard. The nozzle fitment is typiclly formed of linear low density polyethylene or low density polyethylene. The cap is typically formed of polypropylene. The seal membrane may be formed from a heat sealable, peelable, foil laminate. The flexible bag may be formed from low density polyethylene, high density polyethylene, polyethylene terephthalate (PET), or a combination of high and low density polyethylene or a combination of PET and low density polyethylene. The adhesive is typically a pressure sensitive hot melt adhesive.

What is claimed is:

1. A paperboard carton assembly having walls which are adapted to define an exterior and normally closed interior surfaces except for a dispensing opening in one of the walls, a normally closed, liquid impervious, puncturable, flexible bag having two ends and having sides therebetween, one bag end adhesively secured to the surface of another carton wall and the other bag end adhesively secured to the surface of that carton wall having said dispensing opening, a flanged dispensing nozzle fitment having a through opening and whose flange is adhesively secured to and around the periphery of said dispensing opening, a side portion of said bag secured to a portion of said flange of said nozzle fitment, said last recited bag side portion spanning and closing the nozzle opening.

2. The carton assembly of claim 1 wherein said dispensing opening, said nozzle fitment, and said nozzle fitment flange are annular, and wherein said nozzle fitment flange includes a radially innermost portion to which said bag side portion is secured, and a radially outermost portion which is secured to said carton wall around said dispensing opening.

3. The carton assembly of claim 2 wherein said nozzle fitment radially innermost flange portion is thicker than said nozzle fitment radially outermost flange portion.

4. The carton assembly of claim 1 wherein said bag is formed of plastic sheet material.

5. The carton assembly of claim 2 wherein said bag ends and the radially outermost portion of said fitment are both releasably secured to their respective carton walls, the securement of the radially innermost nozzle fitment flange to the bag being stronger than both (a) the securement of the radially outermost nozzle fitment flange to its respective carton wall and (b) the securement of the bag ends to their respective carton walls.

6. The carton assembly of claim 2 wherein said radially innermost flange portion is of a diameter less than the diameter of said dispensing opening.

7. The carton assembly of claim 1 wherein the bag is folded to a collapsed but expandable condition, said bag having gussets extending from one of its ends to the other of its ends.

8. The carton assembly of claim 1 wherein walls are generally rectangular and are all of the same width, and wherein said folded bag is substantially of said width.

9. The carton assembly of claim 1 including first, second, third and fourth rectangular sidewall forming panels hinged in series along parallel fold lines to form a collapsed sleeve, the widths of said first, second, third and fourth side panels being such that, upon forming an erected sleeve and upon expansion of said bag, the bag sides are in surface contact with the surfaces of each of said first, second, third and fourth sidewall forming

10. A bag and carton construction for packaging liquids, the carton formed of paperboard and having walls defining a carton interior and a carton exterior, the carton interior being closed except for a dispensing opening in one wall portion thereof, a flanged nozzle fitment having a through opening and a portion of whose flange is secured to an exterior portion of the carton around said dispensing opening and whose nozzle opening is aligned with said carton dispensing opening, a puncturable, liquid impervious, flexible bag having opposite, closed ends and having sides between its ends, one end of said bag secured to a first interior wall portion and the other bag end secured to a second interior wall portion, a bag side portion secured to said nozzle fitment such that said bag side portion spans the nozzle opening and closes it.

11. The construction of claim 10 wherein the flange of said nozzle fitment is annular and wherein a radially outermost portion of the flange of said nozzle fitment is secured to the carton around the dispensing opening, and wherein a radially innermost portion of the flange of said nozzle fitment is secured to said bag side portion, and wherein said radially outermost flange portion is thinner than said radially innermost flange portion, and wherein said radially innermost flange portion extends at least partially into said dispensing opening.

12. The construction of claim 10 wherein the bag ends and said fitment are both releasably secured to the carton by means of an adhesive.

13. A method of making a package for liquids, the package including a carton and a flexible bag therein, the carton having a liquid dispensing opening in a wall portion thereof, the bag having ends and sides, the steps of adhesively securing each bag end to a respective, different interior wall portion of the carton, adhesively securing the flange of a flanged nozzle fitment to the carton exterior periphery of said dispensing opening so that one end of the nozzle opening communicates with the carton interior, adhesively securing a side portion of the bag to the periphery of that portion of the nozzle fitment opening which communicates with the carton interior so that said bag side portion spans the fitment nozzle opening and closes it, placing a filling tube into the fitment nozzle opening from the exterior of the carton and puncturing that bag side portion which spans the nozzle opening with the end of the filling tube and filling the bag with a liquid from the filling tube.

14. The method of claim 13 wherein the carton interior portion of said nozzle opening is a radially innermost portion of the flange of the nozzle fitment and is thicker than the remainder of said flange, and wherein said thicker flange portion extends at least partially into the carton dispensing opening and is adhesively secured to said bag side portion.

15. The method of claim 13 wherein the bag and nozzle fitment are both fashioned of a plastic material and wherein the carton is formed of paperboard whereby the adhesive securement between the nozzle fitment and said bag side portion is stronger than both (1) the adhesive securement between the bag ends and the carton, and (2) the adhesive securement between the flange of the nozzle fitment and the carton, to thereby permit the bag to be pulled out of the carton by ripping the nozzle fitment away from the carton.

16. A paperboard carton assembly having walls which are adapted to define an exterior and normally closed interior surfaces except for a dispensing opening in one of the walls, a normally closed, liquid impervious, puncturable, flexible bag, a flanged dispensing nozzle fitment having a through opening and having a radially outermost flange portion adhesively secured to and around the exterior periphery of said dispensing opening, a first portion of said bag adhesively secured to a portion of a radially innermost portion of said flange, said first bag portion spanning and closing the nozzle opening, the strength of the adhesive securement of said flange to the periphery of said dispensing opening being less than the strength of the securement of said first bag portion to the radially innermost portion of said flange.

17. The carton assembly of claim 16 wherein a second portion of said bag is adhesively secured to an interior wall surface, the strength of securement of said second bag portion to the interior wall surface being less than the strength of securement of said first bag portion to the radially innermost portion of said flange.

* * * * *